US005800132A

United States Patent [19]

Marietti

[11] Patent Number: 5,800,132

[45] Date of Patent: Sep. 1, 1998

[54] AUTOMOBILE DUAL PURPOSE WATER PUMP DRIVE APPARATUS

[76] Inventor: Gregory A. Marietti, 5048 Postlewaite Rd., Columbus, Ohio 43235

[21] Appl. No.: 647,571

[22] Filed: May 14, 1996

[51] Int. Cl.[6] ..... F01P 5/10

[52] U.S. Cl. ..... 417/238; 417/362; 417/374; 123/41.44; 123/198 C

[58] Field of Search ..... 123/41.44, 41.47, 123/198 C; 417/238, 362, 37 R

[56] References Cited

U.S. PATENT DOCUMENTS

| | | | |
|---|---|---|---|
| 2,584,242 | 2/1952 | Tiffany | 417/374 X |
| 2,902,205 | 9/1959 | Parker | 417/374 X |
| 3,730,147 | 5/1973 | Buchwald | 123/41.44 |
| 4,215,658 | 8/1980 | Smith et al. | 123/198 C |

FOREIGN PATENT DOCUMENTS

| | | | |
|---|---|---|---|
| 58-116229 | 7/1983 | Japan | 123/198 C |

OTHER PUBLICATIONS

Cool Moves article from *Popular Hot Rodding* magazine, Oct. 1993.

*Primary Examiner*—Richard E. Gluck
*Attorney, Agent, or Firm*—Standley & Gilcrest

[57] ABSTRACT

An electric motor is connected via cog belt to a dual purpose pulley on the water pump of an automobile, to increase power available from the engine so that during racing maximum horsepower can be achieved. Enhanced cooling of the engine is also obtained.

1 Claim, 4 Drawing Sheets

AUTOMOBILE DUAL PURPOSE WATER PUMP DRIVE APPARATUS

BACKGROUND AND SUMMARY OF THE INVENTION

The present invention relates generally to apparatus for increasing the performance of engines, and more particularly, is related to an apparatus for cooling an automobile engine while increasing horsepower of the engine.

In conventional automobile engines, the water pump is driven by a belt from the engine crank, consuming power from the engine. This power consumption by the water pump could be used for higher horsepower and performance. Especially in racing cars, every bit of additional power is helpful.

Another factor effecting racing cars is engine temperature. During events it is very important to maintain engine temperature and avoid overheating. Some drivers have resorted to placing bags of ice on the engine or using sprayers to direct a cool water bath over the engine. These types of engine temperature solutions are messy and cumbersome and relatively inefficient.

The present invention provides an electric motor to run the water pump so that the engine does not have to use energy for this purpose. A separate belt drive is provided between the water pump and the motor. In this manner the water pump may be operated when the engine is not running, for cooling purposes. The motor uses electric energy available from the car's battery to drive the water pump.

The present invention incorporates a unique dual purpose pulley having a serpentine drive and a cog drive. The pulley is preferably machined from one piece of aluminum. The serpentine drive has a larger diameter smooth finish belt contact surface. A smaller diameter cog drive is adjacent the serpentine drive. The larger diameter drive may have a v-groove surface instead of the smooth surface in certain applications of the invention.

A bracket is also provided for mounting the water pump motor in the engine compartment of the car. The bracket may preferably include a guide for allowing a swinging motion of the motor to control belt tension. The bracket may be configured to be bolted onto the standard bolt holes in the water pump housing used to mount the water pump to the engine. In another embodiment of the invention the bracket mounts to the air conditioner bracket existing in the car.

The present invention has particular applicability to 5.0 Liter engines in Ford Mustang automobiles from the years 1986 to 1993. However, the invention is also useful in other makes and models by reconfiguring the bracket for different engine compartment spaces.

During racing, a car using the present invention is preferably driven with manual steering so as to bypass the power steering pump. Also, the smog pump may be bypassed during racing. Since it is not uncommon for the engine crank to be driving the smog pump, power steering pump, alternator, water pump, and air conditioning system during normal operation, any bypassing of these devices would increase power available to the drive train of the car. In one preferred embodiment of the present invention the smog pump, power steering pump, and water pump are all bypassed. The water pump is run by the motor described above. The engine crank is then only turning with the alternator and the air conditioning system. With the air conditioning turned off, the engine is effectively only driving the alternator in addition to powering the drive train of the car.

While racing the car, the water pump is operational via the electric motor. When the car is turned off the water pump may be operating, again via the electric motor. With a source of power to the motor, the water pump can continue to cool the engine when the engine is off.

The above and other advantages will be apparent to one of ordinary skill in the art and will become more apparent after reading the following detailed description, drawings, and claims.

DETAILED DESCRIPTION OF PREFERRED EMBODIMENT(S)

Figure 1:
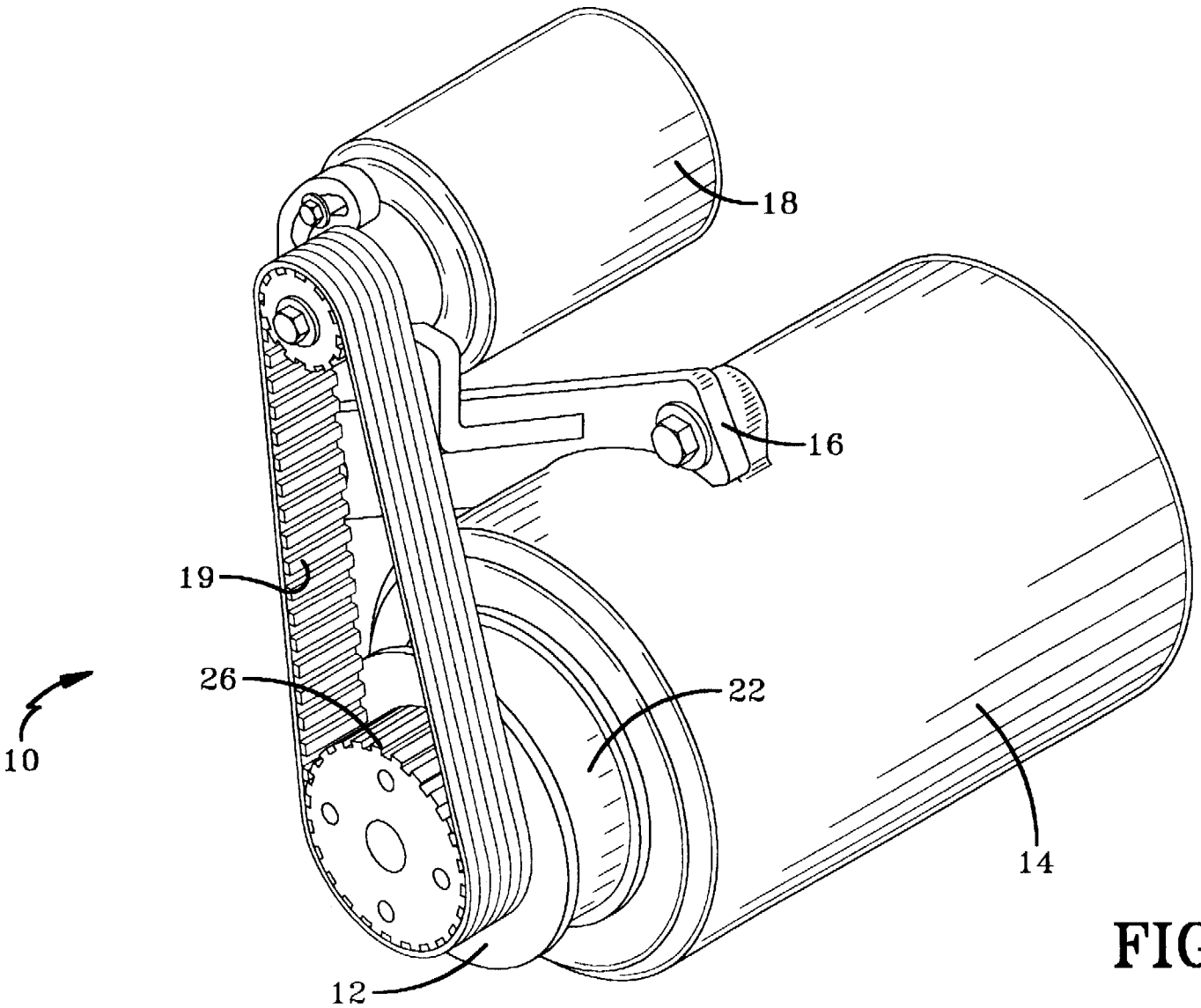
FIG. 1 shows a perspective view of the present invention in use in an automobile engine compartment.
Figure 2B:
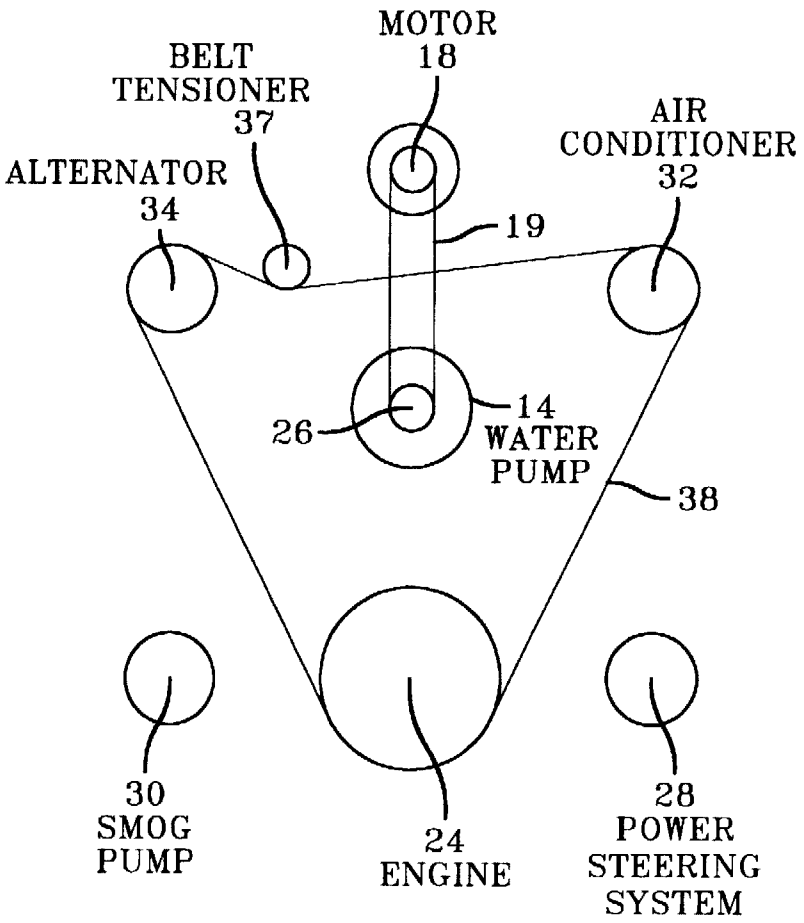
FIG. 2B illustrates a schematic view of the present invention in a race mode configuration.
Figure 2A:
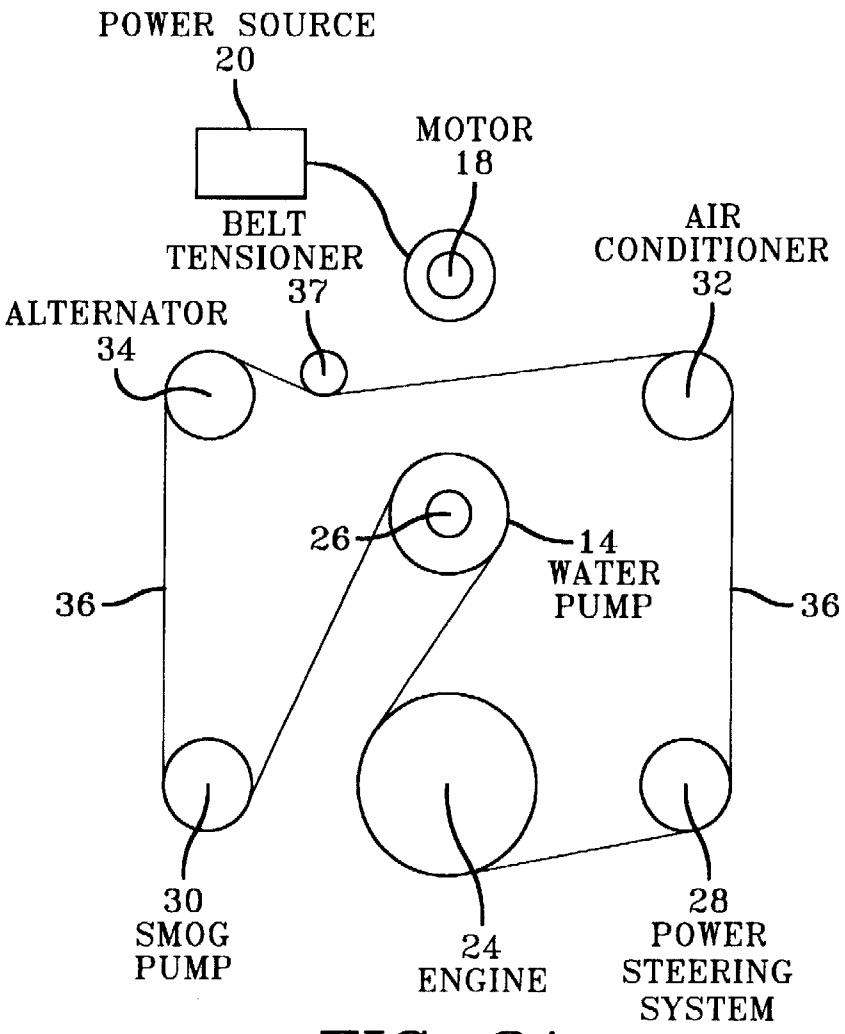
FIG. 2A shows a schematic view of the present invention in association with an automobile engine and several associated systems that may be driven by the engine.
Figure 3:
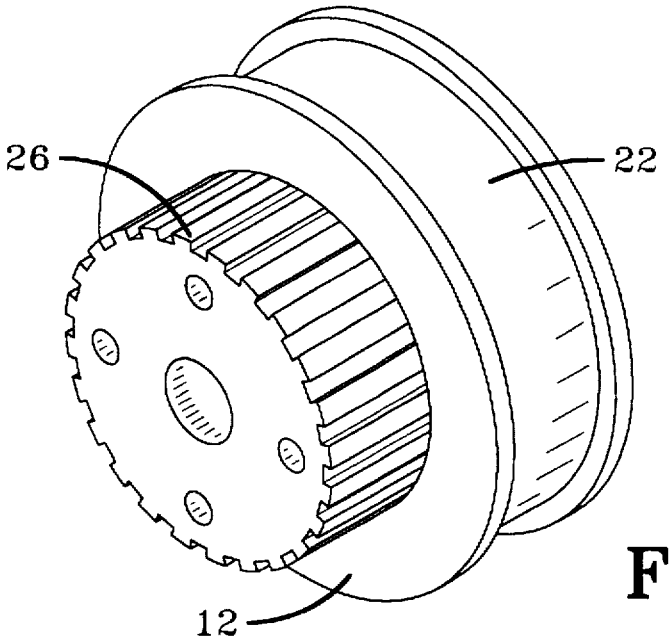
FIG. 3 shows a perspective view of the dual purpose pulley of the present invention.
Figure 4:
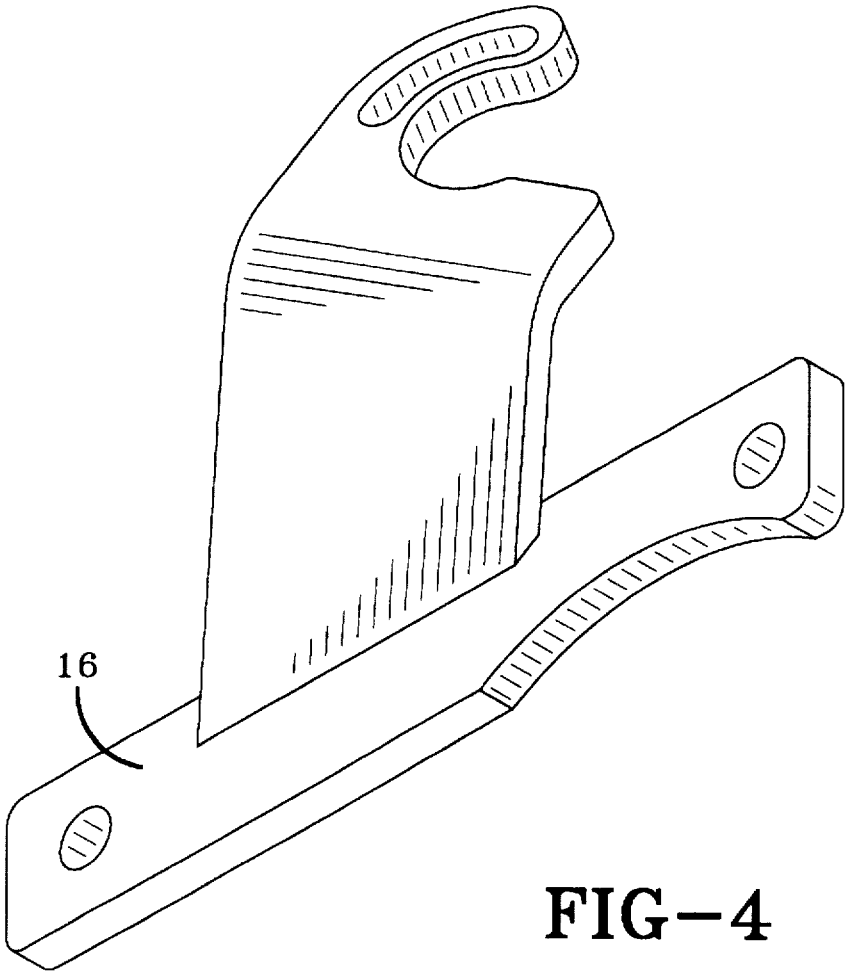
FIG. 4 shows a perspective view of a bracket of one preferred embodiment of the present invention.
Figure 5:
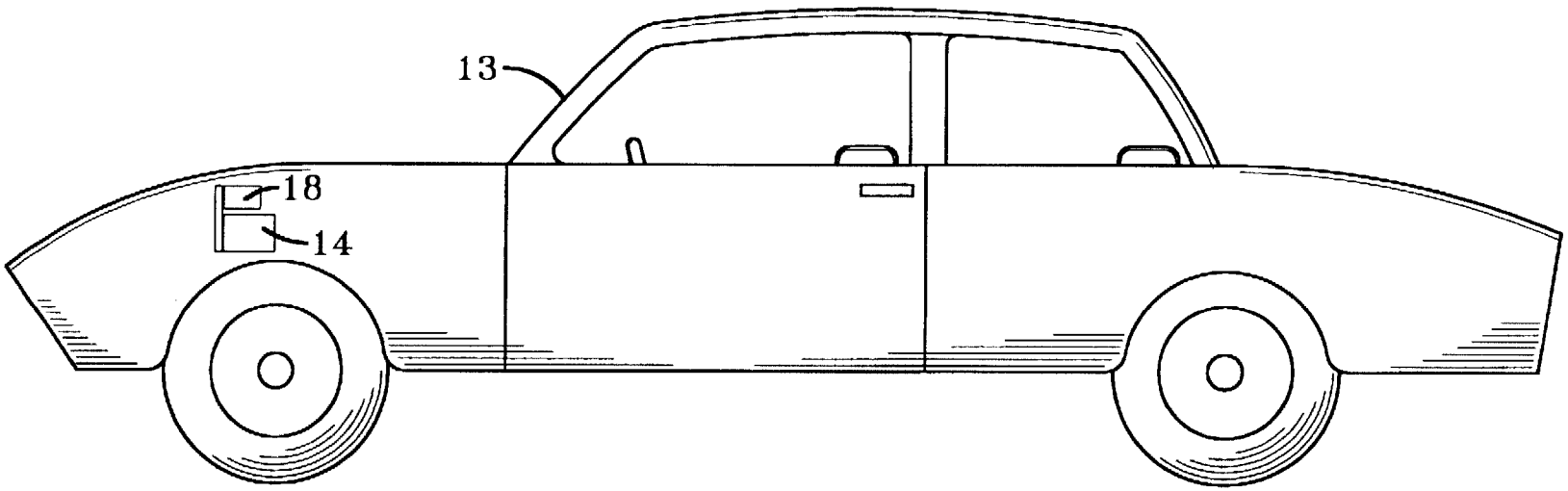
FIG. 5 illustrates the pulley system installed within an automobile.

Referring now to the drawings, the present invention is shown generally at 10. The dual purpose pulley 12 is secured to the water pump 14. A bracket 16 is installed on the water pump 14 and extends to allow attachment of an electric motor 18. The motor 18 is connected to a power source 20 such as the alternator or a dedicated battery. The pulley 12 is preferably used in connection with an automobile 13 engine. FIG. 5 illustrates the pulley 12 located inside the engine compartment of an automobile 13.

The pulley 12 has two drives. The first drive 22 is intended for use when the car is in normal operation and the engine 24 is driving the water pump via the engine belt. The surface of the first drive 22 may be a smooth surface for a serpentine drive or a v-groove surface or even a cog surface depending on the type of belt used in that make and model of car. The second drive 26 of the pulley 12 is a cog which is used to connect the pulley to the drive shaft of the motor 18 via a cog belt 19 or timing belt. This second drive 26 is typically a smaller diameter than the first drive 22. Both drives 22, 26 may be machined from one piece of aluminum, for example.

In a conventional mode, the engine 24 drives a power steering system 28, a smog pump 30, an air conditioning system 32, the water pump 14, and the alternator 34. This is typically accomplished by one serpentine belt 36 connected to all the systems. The serpentine belt 36 may function with a belt tensioner 37. In a bypass mode, the shortened engine belt 38 drives only the alternator 34 and may further be connected to the air conditioning system 32 for purposes of belt tensioning and routing. While in the racing (bypass) mode, the water pump 14 is driven entirely by the motor 18 thereby reducing power drains on the engine 24.

By having a dual purpose pulley 12 the automobile can be quickly converted from racing mode to conventional street use mode by changing belts. With the motor 18 on, and the car in racing mode the second drive 26 of the pulley 12 is in use with the cog belt. In combination use with the cog belt is the shorter serpentine belt 38 which connects the engine crank to the alternator. The first drive 22 of the pulley 12 may be used to drive the water pump 14 by a drive shaft 40 of the water pump 14 in a conventional manner via the engine 24 and serpentine belt 36. In this conventional use mode, the shorter serpentine belt 38 is removed and stored for later racing use.

EXAMPLE INSTALLATION ON 86–93 FORD MUSTANGS

1. Remove the bolts that secure the fan and the existing water pump pulley to the water pump. (Do this with the engine belt installed so the belt will help hold the pulley from rotating while loosening the bolts.)
2. Remove fan blade, engine belt, and existing water pump pulley. (NOTE: make sure you have the correct pulley in the kit: the overall outside diameter should be very close to the existing water pump pulley that is being removed.)
3. Slip the cog belt over the water pump at this time. Pull it back and around the pump, and extend to the A/C line. Use a tie wrap provided to secure the belt to the A/C line when not in use, and make sure it does not interfere with the water pump pulley (once installed).
4. Install the dual purpose water pump pulley and fan on water pump snout. Line up bolt holes as close as possible with pulley to help get bolts started.
5. Snug bolts in evenly, reinstall engine belt, and then tighten water pump bolts in a criss-cross pattern. Do not overtighten. Re-check later after car has been driven.
6. Remove plug in A/C compressor, and bolt behind it. Push out the plastic insert holding this wire to the A/C bracket. Insert washers over the existing stud directly behind the water pump pulley. Install electric motor bracket onto front of A/C bracket. Reinstall A/C compressor bolt through the bracket, and use washer and locknut on the stud at the bottom of the bracket. Install a bolt, washers, and locknut in the middle of the bracket. Tighten all bolts securely. Replace plug in A/C compressor.
7. Install electric motor in bracket, using locknuts. Install pulley on electric motor shaft, with hex screw on pulley to the front.
8. Connect black wire to +12 volt source (preferably use 14 gauge wire) and use an inline 20 amp fuse for example with an appropriate toggle switch of the same rating. Note: Black to positive will turn motor in proper direction, since mustang has reverse rotation water pump. If the black wire is not wired to positive, the motor will run in the wrong direction and fan and water pump will not function. Connect orange lead to good engine ground, or to NEGATIVE terminal on battery.

For street use, use the engine belt as before and make sure cog belt is fastened securely behind dual purpose water pump pulley with wire tie (extending cog belt to A/C line works well).

For drag-racing use, remove the engine belt and replace with the "shorty" race belt. This belt is routed from crank pulley to the alternator, under the belt tensioner, over the A/C pulley and back to the crank pulley. NOTE: The smog pump, water pump and power steering pump are bypassed in this race mode only configuration. This is for off road use only, since an emissions device (smog pump) is not operable. Power steering will not operate and steering effort will be greatly increased, which may cause driver to loose control of the vehicle. If so desired, a different belt can be used to operate the smog pump and power steering pump, while bypassing the water pump. Install cog belt on the dual purpose water pump pulley and electric motor pulley. Adjust motor position in bracket to remove excess slack from belt. Run electric motor for a few seconds to let belt self adjust on the water pump pulley cog teeth. Slide the small pulley on the electric motor shaft rearward until the belt rides against the vertical edge of the water pump pulley. This will eliminate most of the belt chatter. Run the electric motor again for a few seconds, and turn off. Make final adjustment on belt tension by rotating electric motor in bracket. Take just enough slack out of the belt to keep it from chattering.

The present invention has been described in the form of preferred embodiments and it should be recognized that variations may be made by those of skill in the art which variations are intended to fall within the scope of the following claims.

What is claimed is:

1. An engine performance apparatus, comprising:

a water pump;

a bracket secured at a proximal end to said water pump and extending therefrom;

an electric motor secured to a distal end of said bracket; and a dual purpose, one-piece pulley operatively secured to a drive shaft of said water pump, said pulley having a first drive adapted to engage a belt and a second drive with a cog surface adapted to engage a cog belt, such that in a racing mode the second drive is engaged by the electric motor via the cog belt and in a conventional use mode the first drive is engaged by said belt operatively connected to said engine.

* * * * *